United States Patent [19]

Yamaguchi

[11] Patent Number: 4,986,756

[45] Date of Patent: Jan. 22, 1991

[54] ARTISTIC TOY

[75] Inventor: Naoki Yamaguchi, Nagoya, Japan

[73] Assignee: Nichigan Co. Ltd., Aichi, Japan

[21] Appl. No.: 291,170

[22] Filed: Dec. 28, 1988

[51] Int. Cl.[5] ..... G09B 1/16

[52] U.S. Cl. ..... 434/96; 273/157 R; 434/429; 446/118

[58] Field of Search ..... 446/151, 147, 118, 75; 434/96, 159, 160, 167, 168, 172, 190, 200, 208, 428, 429; 273/157 R, 285, 287; 206/315.1

[56] References Cited

U.S. PATENT DOCUMENTS

| | | | |
|---|---|---|---|
| 2,584,601 | 2/1952 | Mauser | 424/159 |
| 2,693,963 | 11/1954 | Moscato | 273/157 R |
| 3,191,937 | 6/1965 | Kropinski | 273/157 R |
| 3,274,727 | 9/1966 | Zander | 446/118 |
| 3,451,681 | 6/1969 | Rossetti | 273/157 R |
| 3,550,945 | 12/1970 | Resnick | 273/157 R |
| 4,809,980 | 3/1989 | Bertrand | 446/118 |

FOREIGN PATENT DOCUMENTS

| | | | |
|---|---|---|---|
| 443726 | 5/1927 | Fed. Rep. of Germany | 273/157 R |
| 424772 | 2/1935 | United Kingdom | 273/157 |
| 1181232 | 2/1970 | United Kingdom | 273/157 R |
| 1446675 | 8/1976 | United Kingdom | 446/118 |
| 2037171 | 7/1980 | United Kingdom | 446/118 |

*Primary Examiner*—William H. Grieb

*Attorney, Agent, or Firm*—Fred Philpitt

[57] ABSTRACT

An artistic toy for producing a desired design, figure or picture includes a support with cells and a plurality of blocks to be mounted in the cells. Once mounted in the cells, the blocks are firmly held therein. The toy further includes a block remover which enables the blocks to be readily removed, one by one, from the cells no matter how the blocks are located relative to one another. Another artistic toy includes (i) a holding plate which can be connected to a support to hold blocks from above, (ii) means for standing an assembled toy of the support, blocks and the holding plate on a flat surface, and (iii) means for hanging the assembled toy on a wall.

6 Claims, 5 Drawing Sheets

1
2
3
3a
3b
4
4a
4b
5
5a
6
7
8
9
9a
9b
10
11
12
A
A

ARTISTIC TOY

FIELD OF THE INVENTION

This invention relates to an artistic toy for producing a desired design, figure or picture from blocks of different colors.

BACKGROUND OF THE INVENTION

A toy is well known which enables a child to make a desired design, figure or picture by mounting blocks of desired shapes and colors in cells. With such a toy, children not only may amuse themselves looking at their products, but also may develop their artistic sentiments through producing desired artworks. In many of the conventional toys of this kind, however, the blocks are prone to be easily removed from the cells if the support in which the cells are formed is vibrated or is given an impact.

SUMMARY OF THE INVENTION

It is an object of the invention to provide an artistic toy for producing a desired design, figure or picture from blocks of different colors, whereby blocks mounted in cells are firmly held therein and are not easily removed therefrom if a support in which the cells are formed is vibrated or is given an impact.

Another object of the invention is to provide an artistic toy of the above-mentioned kind and character which includes means for readily removing the blocks from the cells, one by one, no matter how the blocks are located relative to one another, thereby allowing any desired one of the blocks in the cells to be readily replaced with another one.

Still another object of the invention is to provide an artistic toy for producing a desired design, figure or picture from blocks of different colors, which is capable of being stood on a surface or hung on a wall after an artwork has been produced therein.

Other objects and advantages of the invention will become apparent upon reading a detailed description of preferred embodiments of the invention which will follow.

According to one aspect of the invention, an artistic toy includes a support having cells and blocks of different shapes and colors to be mounted in the cells to produce a desired artwork. Once mounted in the cells, the blocks are held therein so firmly that the blocks are not removed therefrom if the support is vibrated or is given an impact. However, if means designed specially for the removal of the blocks is used, the blocks can be readily removed therefrom, one by one, so as to enable any desired one of the blocks in the cells to be replaced with another one. Therefore, the artwork of the blocks can be easily modified.

According to another aspect of the invention, blocks mounted in cells can be held firmly with a removable holder, or cover, connected to the support, so as to allow the assembled toy to be stood on a surface or hung on a wall, as an ornament.

DETAILED DESCRIPTION OF PREFERRED EMBODIMENTS

Figures 1, 2, 3, 4, 5:
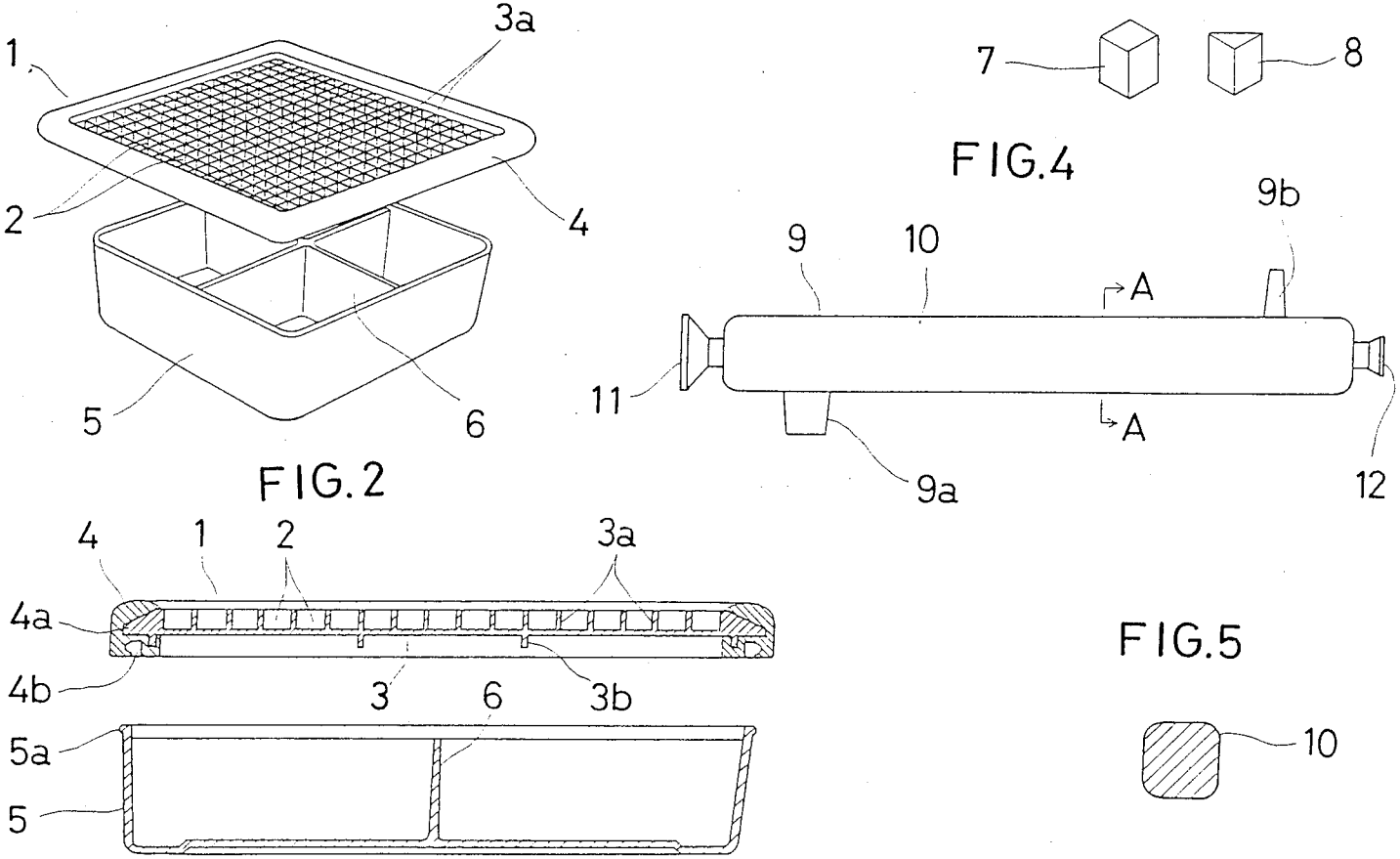
FIG. 1 is a perspective view of an artistic toy of the invention including a support and a container.
FIG. 2 shows the support and the container of FIG. 1 in their vertical cross sections.
FIG. 3 shows two kinds of blocks of different colors which may be mounted in cells of the support of FIG. 1.
FIG. 4 is a side view of a block remover which may be used to remove the blocks from the cells of the support of FIG. 1.
FIG. 5 is a cross section of the block remover of FIG. 4 taken on line A—A of FIG. 4.

Referring now to the drawing, FIGS. 1 to 6 depict an artistic toy which embodies the invention in one preferred form. The toy of FIGS. 1 to 6 comprises (i) a support 1, (ii) blocks and 8 and (iii) a container 5 for storing the blocks.

The support 1 includes a holding structure 3 and a frame 4. The holding structure 3 includes a rectangular bottom plate and a plurality of partition walls 3*a* projecting upward from the upper surface of the bottom plate. The walls 3*a* are formed integrally with the bottom plate. The walls 3*a* are so arranged as to define a plurality of rectangular holes, or cells, 2 for receiving the blocks 7 and 8. The holding structure 3 may be formed of, for example, polystyrene. The frame 4 has an inner groove 4*a*. The structure 3 is fitted into the groove 4*a* at its four sides. The frame 4 may be formed of, for example, vinyl acetate resin.

In the illustrated embodiment, each cell 2 has a square horizontal figure approximately 10 millimeters long at each side. Also, each cell has a depth of approximately 7.5 millimeters. Each partition wall 3*a* has a thickness of approximately 1 millimeter. However, although not shown, each wall 3*a* is slightly tapered in an upward direction.

Ribs 3*b* project downward from the lower surface of the bottom plate of the holding structure 3. The ribs 3*b* serves to reinforce the bottom plate.

The blocks 7 and 8 may be formed of, for example, polystyrene. In the illustrated embodiment, the total number of the cells 2 is 289 and the blocks are also 289 in their total number (although only two of them are shown in FIG. 3). The numbers of the blocks 7 and 8 are nearly the same. In use, desired blocks 7 and/or 8 are mounted in desired cells 2 in order to form a desired design, figure or picture. The blocks 7 are rectangular ones with such dimensions that, once mounted in the cells, they do not naturally come from the cells. Each block 7 has a height substantially twice the depth of the cell 2. Each block 8 has the same shape as obtained by cutting the block 7 at its diagonal line in a vertical direction.

Each of the groups of the blocks 7 and 8 consists of nearly the same number of blocks of four different colors. In the illustrated embodiment, the four different colors are red, blue, green and yellow. The inside of the container 5 is divided into four equal spaces by partition walls 6. Thus, the blocks 7 and 8 may be stored into the respective spaces of the container 5 according to their colors. The container 5 may be formed of, for example, polystyrene.

Figure 6:
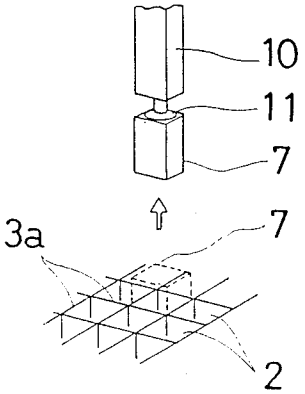
FIG. 6 shows how to use the remover of FIG. 4.

The blocks mounted in the cells 2 may be removed therefrom by using a block remover 9 of FIGS. 4 to 6. The remover 9 includes a handle 10 having two suction cups 11 and 12 of different sizes at its opposed ends. As shown in FIG. 6, the rectangular block 7 may be removed from the cell by the larger cup 11. The smaller cup 12 may be used to remove the triangular block 8.

Figure 7:
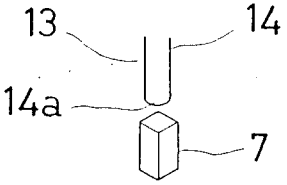
FIG. 7 shows a block remover which may be used if the blocks of FIG. 3 are modified in a first manner.
Figure 15:
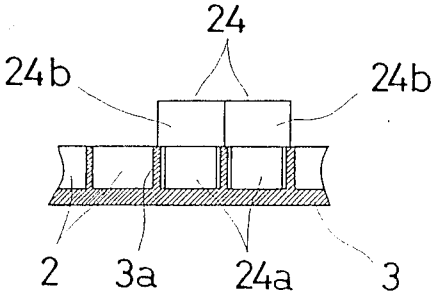
FIG. 15 shows the blocks of FIG. 14 as mounted in the cells.

Alternatively, magnetic material may be included in the blocks 7 and 8, when producing the blocks, so that the blocks can be attracted, or removed, from the cells by a magnetized means. In such a case, a block remover 13 of FIG. 7 may be used. The remover 13 comprises a handle 14 having a magnetized lower end 14*a* to remove the magnetic blocks.

Figure 9:
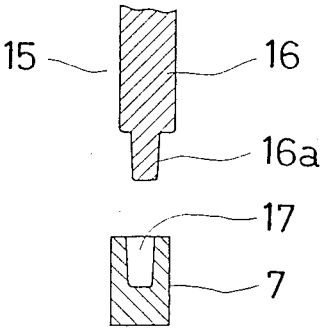
FIG. 9 is a vertical cross section of the remover of FIG. 8.

Also, to facilitate the removal of the blocks, if desired, the blocks may be recessed to accommodate a reliable block removing means. One example of such arrangements is shown in FIG. 9. In FIG. 9, the block 7 has an upwardly-tapered recess 17 therein, and a block remover 15 comprises a handle 16 and opposed outwardly-tapered end portions 16*a* and 16*b* (not shown) which have smaller diameters than the handle 16. Thus, one of the end portions of the remover 15 can be mated with the recess 17 of the block 7 in order to remove the block from the cell.

If desired, as illustrated, the remover of FIG. 4 may be provided with projections 9*a* and 9*b* having the same function as the end portions 16*a* and 16*b* of the remover 15 of FIG. 9.

As shown in FIG. 2, the frame 4 of the support 1 has a groove 4*b* into which the tops of the four sides of the container 5 can be fitted to join the support 1 and the container 5 together.

In use, the support 1 is removed from the container 5, and is placed on a table or the like. Then, desired blocks 7 and/or 8 are mounted in desired cells 2 of the support 1 to produce a desired colored design, figure or picture. Thus, it is possible to produce, for example, such a desired picture of a house with different colors as shown in FIG. 10 or such a desired picture of a flower with different colors as shown in FIG. 11.

All the blocks mounted in the cells can be removed with the remover 9. The blocks removed may be stored in the respective four spaces according to their colors. The container 5 may be covered with the support 1.

Figure 10:
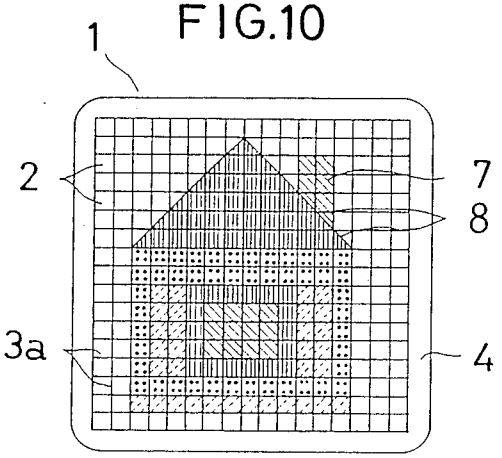
FIG. 10 shows a picture produced by using the blocks of FIG. 3.
Figure 11:
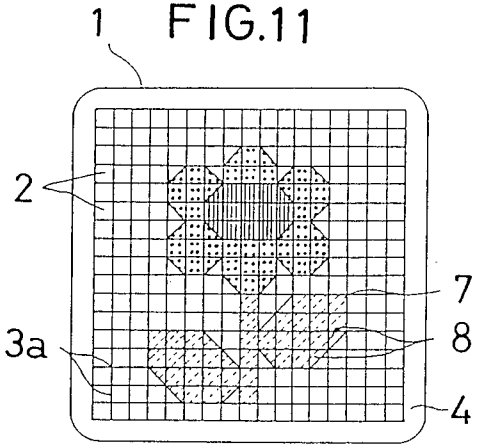
FIG. 11 shows another picture produced by using the blocks of FIG. 3.
Figure 8:
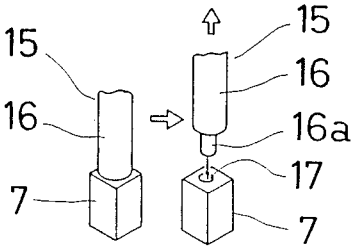
FIG. 8 shows a block remover which may be used if the blocks of FIG. 3 are modified in a second manner.

Many pictures of the blocks are produced by locating most of the blocks adjacently to one another, as illustrated in FIG. 10 or 11. Therefore, in many cases, most of the blocks of the picture are incapable or almost incapable of being easily removed from the cells by picking up the blocks between fingers. However, the blocks can be easily removed with the remover. Thus, according to the invention, any one of the blocks mounted in the cells can be easily replaced with another one to modify the picture.

Figure 12:
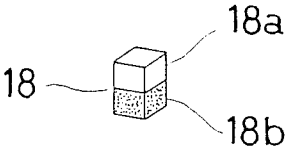
FIG. 12 shows another kind block which may be mounted in the cell.

For the toy of the invention, if desired, a block 18 of FIG. 12 with upper and lower halves 18*a* and 18*b* of different colors may be used. Such a block may be mounted upside down into the cell 2 to show the different color. For such a block, the cells may be formed with depths greater than one half of the height of the cell in order to completely prevent a portion of the lower half of the block from being exposed.

Figure 13:
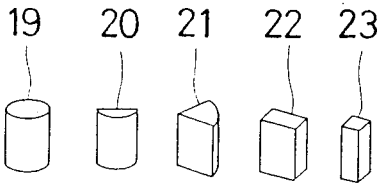
FIG. 13 shows five additional kinds of blocks which may be mounted in the cells.
Figure 14:
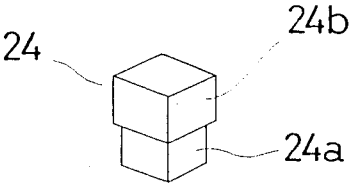
FIG. 14 also shows a further kind of block which may be mounted in the cells.

Also, colored blocks 19 to 23 of FIG. 13 may be used for the toy. All the blocks 19 to 23 have the same height as the blocks of FIGS. 3 and 12. The block 19 is a cylindrical one with such a diameter that the block 19 can be held firmly in the cell 2. The block 20 has the same shape as one half of the block 19 obtained by cutting the block 19 into two exact halves in its vertical direction. The block 21 has the same shape as one half of the block 20 obtained by cutting the block 20 into two exact halves in its vertical direction. The block 22 has the same shape as one half of the rectangular block 7 of FIG. 3 obtained by cutting the block 7 into two exact halves in its vertical direction. The block 23 has the same shape as one half of the rectangular block 22 obtained by cutting the block 22 into two exact halves in its vertical direction.

Also, blocks 24 may be used for the toy. As illustrated, each block 24 consists of rectangular upper and lower halves 24*b* and 24*a*, but the upper half 24*b* is larger than the lower half 24*a*. The lower half 24*a* has such a size that the lower half 24*a* can be fitted into the cell 2. The upper half 24*b* has such a size that, when the lower half 24*a* is in the cell, the upper half 24*b* is in close contact with the upper halves 24*b* of the adjacent blocks 24 in the adjacent cells. Thus, if such blocks 24 are mounted in the cells, the tops of the partition walls 3*a* are completely covered with the blocks 24 and, hence, are kept from sight. Therefore, the blocks 24 may be used to produce a clearer and, hence, more beautiful artwork.

Figure 16:
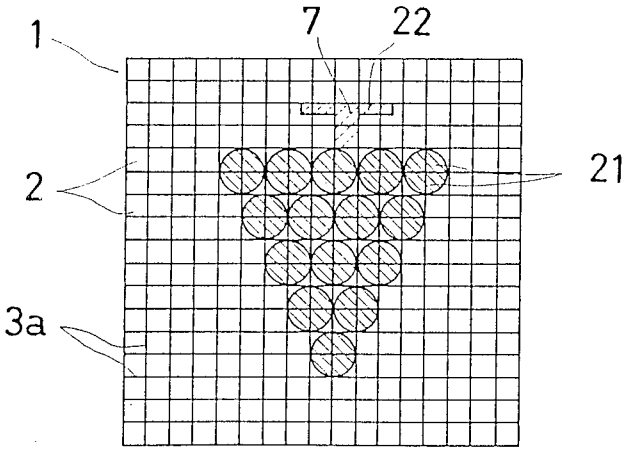
FIG. 16 shows still another picture produced according to the invention.
Figure 17:
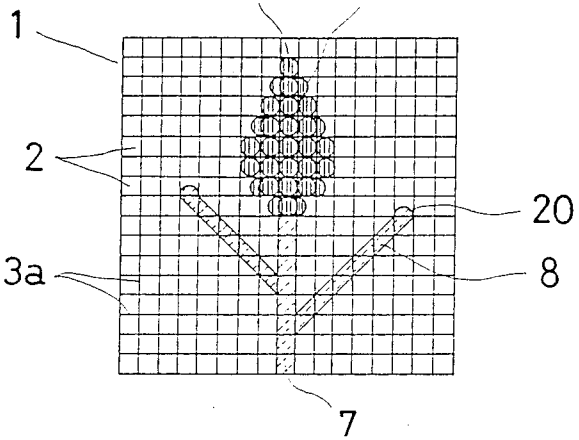
FIG. 17 shows a further picture produced according to the invention.

FIG. 16 shows a picture produced by using the rectangular blocks 7 (of FIG. 3), the quadrantal blocks 21 (of FIG. 13), the rectangular blocks 22 (of FIG. 13) and 23 (of FIG. 13). FIG. 17 shows a picture produced by using the rectangular blocks 7 (of FIG. 3), the triangular blocks 8 (of FIG. 3), the circular blocks 19 (of FIG. 13) and the semicircular blocks 20 (FIG. 13).

Figure 18:
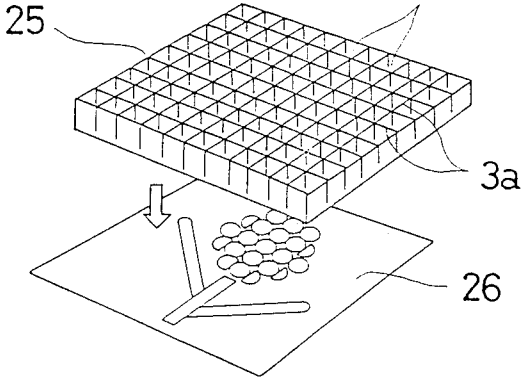
FIG. 18 is a perspective view of a second support according to the invention.

If desired, a support 25 of FIG. 18 may be used instead of the support 1. A major difference between the supports 25 and 1 is that the support 25 has a transparent bottom plate. Thus, if the support 25 is used, the user can place a sheet 26 of a model on a table and place the support 25 on the model so that the user may decide, looking at the model through the bottom plate, a block of which color and shape is to be mounted in which cell in order to make an exact picture after the model. Thus, with the toy having such a support 25, even a very young child can make a picture.

Figure 19:
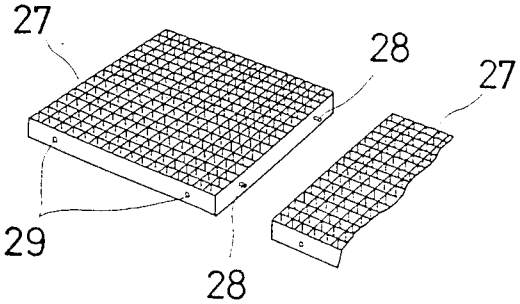
FIG. 19 shows a third support according to the invention.
Figure 20:
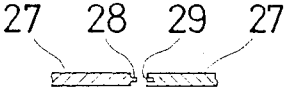
FIG. 20 shows how the support of FIG. 19 can be joined with another support with the same construction.

Also, if it is desired to make a larger artwork, a support 27 of FIG. 19 may be used instead of the support 1 or 25. The support 27 has two projections 28 at each of opposed sides thereof and has two recesses 29 at each of the other opposed sides thereof. Such a support 27 can be joined with other supports 27 of the same construction by inserting the projections 28 into the recesses 29 (FIG. 20), so as to provide a larger support with which a larger artwork can be produced. If desired, instead of providing the projections 28 and recesses 29, opposed sides of the support may be magnetized and the other opposed sides thereof may be formed of magnetic material.

Figure 21:
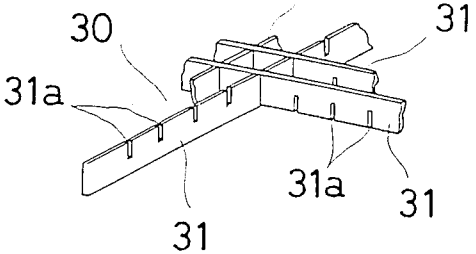
FIG. 21 shows a fourth support according to the invention.

FIG. 21 shows a support 30 which can be assembled by the user. The support 30 comprises a first group of removable partition walls 31 arranged in the same direction and having lower vertical grooves 31*a* and a second group of removal partition walls 31 arranged in the horizontal perpendicular direction and having upper vertical grooves 31*a*. As illustrated, the first and second groups of the walls 31 intersect at their grooves. The support 30 has no bottom. Thus, such a support 30 can be easily assembled. The support 30 may be placed on a flat surface as it is.

FIGS. 22 to 25 depict an artistic toy which embodies the invention in another preferred form. A major difference between this second toy and the first toy is that the second toy, with an artwork of blocks produced therein, not only may be placed on a flat surface, but also may be stood on such a surface or may be hung on a wall.

The toy of FIGS. 22 to 25 includes a support 32 having a holding structure 33. The structure 33 has partition walls and a rectangular frame 34. The partition walls are so arranged to provide rectangular cells 2. The frame 34 has four upper projections 35 at the respective corners thereof. The tops of the projections 35 are at the same level as the tops of blocks 7 mounted in the cells 2. Each projection 35 has a nut 36 therein. The toy of FIGS. 22 to 25 further includes a cover, or holder 37, for holding the blocks 7 mounted in the cells to prevent the blocks from coming from the cells when the toy with the blocks is stood on a flat surface or is hung on a wall. The holder 37 has substantially the same length and width as the support 32. Also, the holder 37 is formed of a transparent plate of suitable material such as acrylic resin. Also, the holder 37 has four openings 39 at its points corresponding to the nuts 36 of the frame 34. Screws 38 with decorative heads are inserted through the respective openings 39 when the holder 37 is to be connected to the support 32.

When it is desired to stand an artwork of the blocks 7 produced in the support 32 on a flat surface or to hang the artwork on a wall, the screws 38 are inserted through the openings of the holder 37 and are engaged with the nuts 36 of the support 32. The holder 37 is thus connected to the support 32. The holder 37 connected to the support 32 presses against the tops of the blocks mounted in the cells. The blocks are thus prevented from coming out of the cells when the assembled toy is stood or hung.

Figure 24:
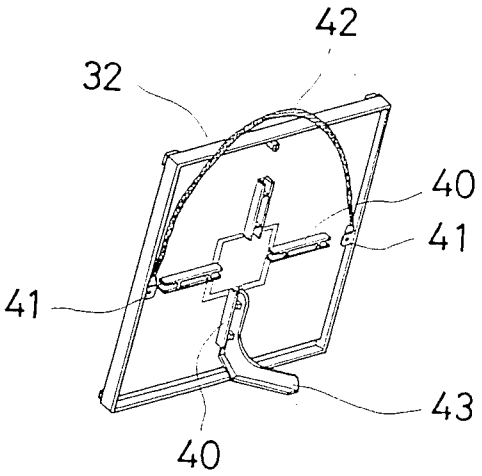
In FIG. 24 the support of FIG. 22 is stood by an angled stand.
Figure 25:
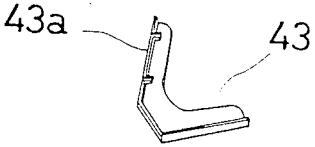
FIG. 25 is a side view of the stand of FIG. 24.
Figure 22:
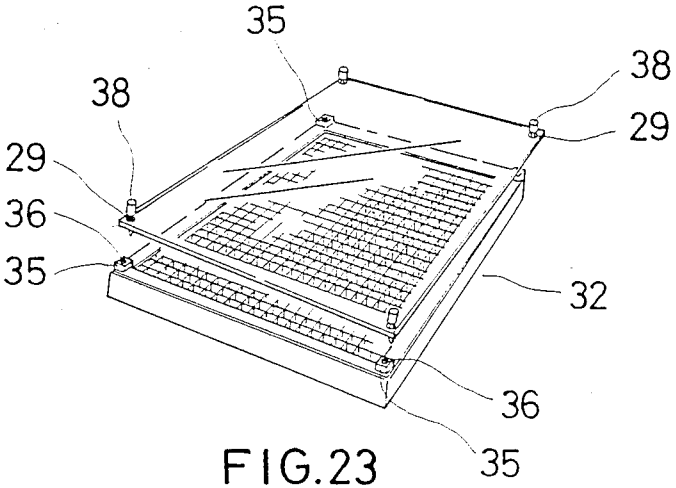
FIG. 22 shows another artistic toy of the invention including a support and a holding plate.

As shown in FIG. 24, the support 32 has four pairs of stand holders 40, on its back, which are arranged crosswise relative to one another. The holders 40 of each pair are so spaced apart from each other as to hold an upper inclined portion 43*a* of an angled stand 43 fitted between the holders 40. The stand 43 is used, in such a manner, to support the support 32 when it is desired to stand the assembled toy on a flat surface. Also, the support 32 has, on its back, a pair of removable fastener means 41. A string 42 is fastened at its opposed ends to the respective fastener means 41. The string 42 may be used to hang the assembled toy on a wall.

Figure 23:
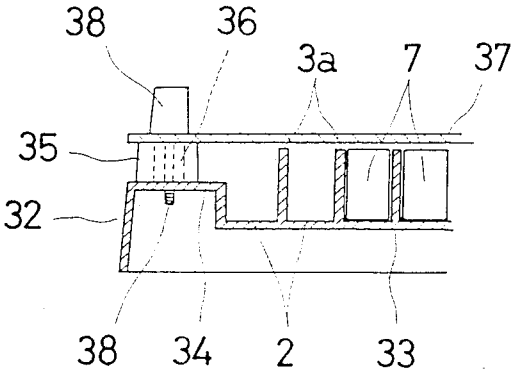
FIG. 23 shows how the holding plate of the toy of FIG. 22 can be connected to the support.

If such a toy is not used without holding the blocks 7 with the holder 37, each block 7 may not be of such a size as to snugly fit in the cell, but may be so sized as to stay therein relatively loosely as illustrated in FIG. 23. And, if the blocks are formed with such a loose size, the blocks can be removed from the cells merely by removing the holder 37 and turning the support 32 over. This facilitates the making of a new artwork of the blocks.

If desired, numerals and signs such as "+", "−" and "=" may be depicted on the tops of the blocks in order to use the blocks as teaching tools for calculation. Also, if desired, letters may be depicted thereon to provide teaching blocks for language.

Also, the foregoing embodiments of the invention may be so modified as to provide cells which, as a whole, have a zigzag shape or a spiral shape, for example.

According to the first embodiment of the invention, once mounted in the cells, the blocks are held therein so firmly that the blocks are not removed therefrom if the support is vibrated considerably or is given a great impact. Hence, once a desired artwork of the blocks is produced, the artwork is not destroyed on such occasions. Also, according to the first embodiment, no matter how the blocks are located relative to one another, the blocks may be easily removed from the cells with the block remover and, hence, any desired one of the blocks may be readily replaced with another one.

According to the second embodiment of the invention, the blocks mounted in the cells can be held firmly with the holder, or cover, so as to allow the assembled toy to be stood on a flat surface or hung on a wall, as an ornament.

What is claimed is:

1. An artistic toy kit for producing a variety of creative designs and pictures, said kit comprising (a) a support structure (1) that includes a rectangular bottom plate and a plurality of partition walls (3*a*) projecting upwardly from the bottom plate so as to define a plurality of cells (2) that have sides and bottoms but open tops, (b) a plurality of blocks (7, 8) that are sized and contoured to fit within said plurality of cells (2), (c) at least one block remover (9) which is adapted to engage the upper surfaces of said blocks (7, 8) in such a way as to facilitate removal of said blocks (7, 8) from said cells (2), (d) a storage container (5) for said plurality of blocks, said container having an upper opening that has an area substantially corresponding to the area of said rectangular bottom plate set forth in (a), and (e) engaging means (4*a*) on the underside of said support structure (1) and engaging means (5*a*) adjacent the upper opening of said storage container (1) that are contoured so as to engage with each other so that support structure (1) can serve as a closure lid for said storage container (5).

2. An artistic toy kit for producing a variety of creative designs and pictures, said kit comprising (a) a support structure (1) that includes a rectangular bottom plate and a plurality of partition walls (3*a*) projecting upwardly from the bottom plate so as to define a plurality of cells (2) that have sides and bottoms but open tops, (b) a plurality of blocks (7, 8) that are sized and contoured to fit within said plurality of cells (2), (c) at least one block remover (9) which is adapted to engage the upper surfaces of said blocks (7, 8) in such a way as to facilitate removal of said blocks (7, 8 ) from said cells (2), (d) a storage container (5) for said plurality of blocks, said container having an upper opening that has an area substantially corresponding to the area of said rectangular bottom plate set forth in (a), (e) engaging means (4*a*) on the underside of said support structure (1) and engaging means (5*a*) adjacent the upper opening of said storage container (1) that are contoured so as to engage with each other so that support structure (1) can serve as a closure lid for said storage container (5), and (f) a rectangular sheet of clear plastic (37 ) having an area corresponding to the total area of the open tops of said plurality of cells (2) and means (38) for securing said sheet (37) to the support structure so that said sheet (37) will cover the open tops of said cells (2) and thereby insure that blocks (7, 8) will be retained in said cells (2).

3. An artistic toy kit for producing a variety of creative designs and pictures, said kit comprising (a) a support structure (1) that includes a rectangular bottom plate and a plurality of partition walls (3*a*) projecting upwardly from the bottom plate so as to define a plurality of cells (2) that have sides and bottoms but open tops, (b) a plurality of blocks (7, 8) that are sized and contoured to fit within said plurality of cells (2), (c) at least one block remover (9) which is adapted to engage the upper surfaces of said blocks (7, 8) in such a way as to facilitate removal of said blocks (7, 8 ) from said cells (2), (d) a storage container (5) for said plurality of blocks, said container having an upper opening that has an area substantially corresponding to the area of said rectangular bottom plate set forth in (a), (e) engaging means (4*a*) on the underside of said support structure (1) and engaging means (5*a*) adjacent the upper opening of said storage container (1) that are contoured so as to engage with each other so that support structure (1) can serve as a closure lid for said storage container (5), (f) a rectangular sheet of clear plastic (37 ) having an area corresponding to the total area of the open tops of said plurality of cells (2) and means (38) for securing said sheet (37) to the support structure so that said sheet (37) will cover the open tops of said cells (2) and thereby insure that blocks (7, 8) will be retained in said cells (2), and (g) supporting means (42, 43) for supporting said support structure (1) in an essentially vertical position after said cells (2) have been filled with the desired number of blocks (7, 8).

4. A kit according to claim 1 wherein said blocks (7, 8) has a numeral, letter or design on its upper surface.

5. A kit according to claim 2 wherein said blocks (7, 8) has a numeral, letter or design on its upper surface.

6. A kit according to claim 3 wherein said blocks (7, 8) has a numeral, letter or design on its upper surface.

* * * * *